US005405469A

United States Patent [19]

Lin

[11] Patent Number: 5,405,469

[45] Date of Patent: Apr. 11, 1995

[54] METHOD FOR FORMING GLOBE MAP ON RUBBER BASKETBALL

[76] Inventor: Shen-Lai Lin, No. 28, Alley 60, Lane 265 Sec. 2, Ta Kuaw Rd., Pan Chiao, Taiwan, Prov. of China

[21] Appl. No.: 138,122

[22] Filed: Oct. 15, 1993

[51] Int. Cl.[6] ..... A63B 41/08; A63B 41/10

[52] U.S. Cl. ..... 156/147; 156/145; 156/146; 156/156; 156/228; 156/242; 156/245; 156/277; 434/138; 434/133; 273/65 R; 273/65 EA; 273/65 E

[58] Field of Search ..... 156/228, 145–147, 156/156, 245, 242, 277; 434/133, 137, 138; 273/65 R, 65 E, 65 EA, 65 ED

[56] References Cited

U.S. PATENT DOCUMENTS

| | | | |
|---|---|---|---|
| 2,635,358 | 4/1953 | George | 434/138 |
| 2,936,366 | 5/1960 | Rainford | 434/138 X |
| 4,093,219 | 6/1978 | Piraud | 273/65 ED X |
| 4,187,134 | 2/1980 | Svub et al. | 273/65 ED X |
| 5,040,795 | 5/1994 | Sonntag | 273/58 R |

FOREIGN PATENT DOCUMENTS

| | | | |
|---|---|---|---|
| 53-61668 | 6/1978 | Japan | 273/65 E |
| 13734 | of 1891 | United Kingdom | 434/138 |

*Primary Examiner*—Jeff H. Aftergut

*Attorney, Agent, or Firm*—Lackenbach Siegel Marzullo Aronson & Greenspan

[57] ABSTRACT

A method for forming a globe map on a rubber basketball having an inner ball base comprising steps of a) providing plural pieces of particularly shaped rubber pieces which can be put together to form a spherical piece, b) printing plural globe map elements, which are respectively corresponding to said rubber pieces and can be gathered together to constitute said globe map, respectively on said rubber pieces, c) respectively adhering said rubber pieces on said inner ball base, d) providing a mold, e) putting said ball base adhered with said rubber pieces in said mold, and f) vulcanizing said rubber pieces adhered to said ball base in said mode for permitting said rubber pieces to be integrally formed. Such method can permit an exquisite and delicate globe map to be printed on a basketball satisfactorily/economically/easily.

6 Claims, 1 Drawing Sheet

METHOD FOR FORMING GLOBE MAP ON RUBBER BASKETBALL

BACKGROUND OF THE INVENTION

The present invention relates generally to a method for forming a globe map on a rubber basketball.

Because the basketball is spherical, the basketball printed with a globe map is an educational object in that the player can possibly learn the world geographic knowledge when playing it.

The conventional methods for forming a figure on a basketball include:

a) After having been produced, the basketball is applied with surface finishes or paints and then is put into a basketball mold. Then the basketball mold with the basketball is heated and thus there will be a colored polymeric film layer left on the surface of the basketball after the solvent of the surface finishes or paints is volatilized. This method is usually applied, but can only produce simple figures rather than exquisite and fine figures.

b) The second method is to apply a cellophane which is printed with a figure to be adhered on a basketball. After a heat treatment, the figure is separated from the cellophane and is re-printed on the surface of the basketball. A small figure such as a trademark can use this method, whereas, because the basketball is spherical, a large figure such as a globe map is not suitable to be produced by this method.

c) The third method is artificial painting. Obviously, this method cannot meet the industrial demand of mass production.

To sum up, the disadvantages of the conventional methods include: p1 A) The large figures cannot satisfactorily be formed on the basketball.

B) The exquisite figures cannot satisfactorily be formed on the basketball.

C) The accurate figures cannot satisfactorily be formed on the basketball.

D) The figures including many colors cannot satisfactorily be formed on the basketball.

It is therefore attempted by the Applicant to deal with the above situation encountered by the prior art.

SUMMARY OF THE INVENTION

An object of the present invention is to provide a method for forming an exquisite and delicate globe map on a basketball. A further object of the present invention is to provide a method for forming a globe map on a basketball, which meets an industrial need of mass production.

In accordance with a method for forming a globe map on a rubber basketball having an inner ball base comprising the steps of: a) providing plural pieces of particularly shaped rubber pieces which can be put together to form a spherical piece, b) forming (e.g., printing) plural globe map elements, which are respectively corresponding to said rubber pieces and can be gathered together to constitute said globe map, respectively on said rubber pieces, c) respectively adhering said rubber pieces on said inner ball base, d) providing a mold, e) putting said ball base adhered with said rubber pieces in said mold, and f) vulcanizing said rubber pieces adhered to said ball base in said mold for permitting said rubber pieces to be integrally formed.

Certainly, the plural rubber pieces can be six rubber pieces. The plural rubber pieces can be adhered to said inner ball base by an adhesive. The adhesive can be a glue or a resin. The rubber pieces can be vulcanized at 180° C. for 10 minutes. The rubber pieces can be vulcanized by a vulcanizing agent. The vulcanizing agent can be sulfur. The rubber pieces can be olive-shaped. The rubber globe map elements can be respectively formed on the rubber pieces by printing.

The present invention can be more fully understood by reference to the following description and accompanying drawing, which form an integral part of this application.

DETAILED DESCRIPTION OF THE PREFERRED EMBODIMENT

Figure 1:
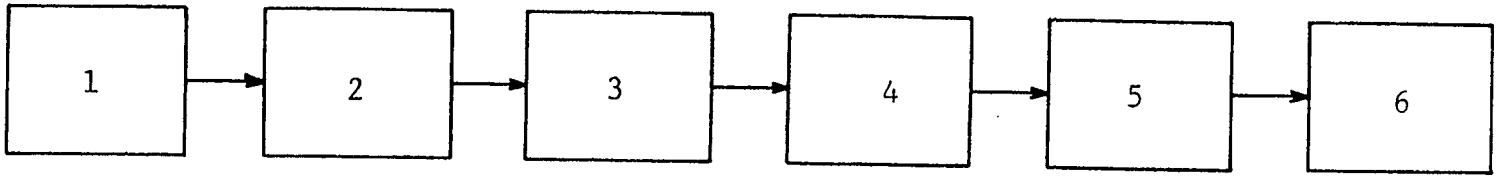
FIG. 1 shows a block diagram of a method for forming a globe map on a rubber basketball according to the present invention.

The method for forming a globe map on a rubber basketball having an inner ball base according to the present invention includes the steps as shown in FIG. 1:

a) providing plural pieces of particularly shaped rubber pieces which can be put together to form a spherical piece (1);

b) forming (e.g., printing) plural globe map elements, which respectively correspond to the rubber pieces and can be gathered together to constitute the globe map, respectively on the rubber pieces (2);

c) respectively adhering the rubber pieces on the inner ball base by an adhesive such as a glue or a resin (3);

d) providing a mold (4);

e) putting the ball base adhered with the rubber pieces in the mold (5); and f) vulcanizing the rubber pieces adhered to the ball base in the mold by a vulcanizing agent such as sulfur at 180° C. for 10 minutes for permitting the rubber pieces to be integrally formed (6).

It is to be noticed that the plural rubber pieces can be six olive-shaped rubber pieces.

During the vulcanizing reaction, because the basketball mold is heated at 180° C. for 10 minutes, the rubber pieces and the inner ball base will be integrally formed and meanwhile the rubber pieces will reach a plastic point to have their outer surfaces fit into the dotted surface of the basketball mold. Thus, the gaps of the rubber pieces adhered on the inner ball base will disappear and the rubber piece will firmly be adhered on the inner ball base after the heat treatment. The applied vulcanizing agent is, as what is well known, to permit the rubber pieces to have a desired hardness and a desired elasticity.

Of course, the printed basketball can be coated with a clear lacquer to obtain a final product.

While the present invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims whose scope is to be accorded the broadest interpretation so as to encompass all such modifications and equivalent structures.

What is claimed is:

1. A method for forming a globe map on a rubber ball having an inner ball base comprising the steps of:

a) providing a plurality of rubber segments shaped to form a sphere when all said segments are in juxtaposition with adjacent segments, and when put together form a spherical body;

b) forming plural globe map elements by printing on said plurality of rubber segments, which plural globe map elements on said rubber segments, when gathered together, form a globe map;

c) adhering said plurality of rubber segments on an inner ball base by adhesive means to fore said globe map;

d) providing a mold;

e) inserting said inner ball base having said segments adhered thereto in said mold; and f) employing a vulcanizing agent to vulcanize, with an application of heat, said rubber segments adhered to said inner ball base in said mold, after said printing step so as to enable said rubber segments to be integrally joined to said inner ball base, forming a globe map on a unitary and permanent rubber ball.

2. A method according to claim 1 wherein said adhesive is a glue.

3. A method according to claim 1 wherein said adhesive is a resin.

4. A method according to claim 1 wherein said rubber pieces are vulcanized at 180° C. for 10 minutes.

5. A method according to claim 4 wherein said vulcanizing agent is sulfur.

6. A method according to claim 1, wherein said formed globe map is coated with a clear lacquer so as to form a final finished product.

* * * * *